US006354302B1

(12) United States Patent
Bingham

(10) Patent No.: US 6,354,302 B1
(45) Date of Patent: Mar. 12, 2002

(54) ADJUSTABLE DEVICE FOR SNUFFING OUT SMOKING TOBACCO PRODUCTS OF VARIOUS DIAMETERS

(76) Inventor: Michael C. Bingham, 265 N., 100 East, Price, UT (US) 84501

( * ) Notice: Subject to any disclaimer, the term of this patent is extended or adjusted under 35 U.S.C. 154(b) by 0 days.

(21) Appl. No.: 09/603,609

(22) Filed: Jun. 26, 2000

Related U.S. Application Data

(60) Provisional application No. 60/174,761, filed on Jan. 6, 2000.

(51) Int. Cl.[7] ..... A24F 13/18; A24F 13/16

(52) U.S. Cl. ..... 131/256; 131/175; 131/237; 131/235.1; 131/240.1; 131/241; 131/242; 206/246

(58) Field of Search ..... 131/256, 175, 131/237, 235.1, 240.1, 241, 242; 206/246

(56) References Cited

U.S. PATENT DOCUMENTS

| | | | | |
|---|---|---|---|---|
| 2,120,027 A | | 6/1938 | Johnson | |
| 2,246,642 A | | 6/1941 | Stachowiak | |
| 2,335,674 A | | 11/1943 | Horlick | |
| 2,536,302 A | | 1/1951 | Mertzel | |
| 3,173,641 A | | 3/1965 | Dorrance | |
| 4,660,575 A | * | 4/1987 | Andreason et al. | 131/256 |

* cited by examiner

*Primary Examiner*—Stanley S. Silverman
*Assistant Examiner*—Dionne A. Walls

(57) ABSTRACT

A device for snuffing out smoking tobacco products of various diameters. The device is comprised of a housing having a first open end, a second closed end, and a cavity formed therebetween; a slider within the cavity having an opening defined by an inner surface for accepting a burning end of a smoking tobacco product; and an adjustable retainer disposed within the opening wherein the retainer and the slider work in concert to snugly accept the burning end of the smoking tobacco product.

15 Claims, 3 Drawing Sheets

ADJUSTABLE DEVICE FOR SNUFFING OUT SMOKING TOBACCO PRODUCTS OF VARIOUS DIAMETERS

PRIORITY OF THE INVENTION

This application claims priority to U.S. Provisional Application No. 60/174,761, filed Jan. 6, 2000.

FIELD OF THE INVENTION

The present invention relates to a portable and adjustable smoking tobacco product extinguisher/snuffer which is particularly adapted for use with various sized cigarettes.

BACKGROUND OF THE INVENTION

Many cigarette and cigar extinguishers and snuffers exist as have been disclosed in various patents. For example, U.S. Pat. No. 2,120,027 describes a cigarette extinguisher with a plurality of flanges at the bottom of a hollow cylinder to receive and hold the lighted end of a cigarette. Additionally, U.S. Pat. No. 2,335,674 discloses a two piece cigarette holder where a cigarette is placed in one end of a barrel piece and a cap piece is then placed thereon to cover the unlit end. Similarly, U.S. Pat. No. 2,246,642 and U.S. Pat. No. 2,536,302 both disclose two piece cigarette extinguishers. U.S. Pat. No. 3,173,641 discloses a combination ash tray and snuffer comprised of a short closed end tube in which the lighted end of a cigarette is placed. A base is used to position the tube to receive the cigarette which is held in the snuffer by gravity. U.S. Pat. No. 2,715,961 discloses a three piece safety extinguisher with two compartments. The first compartment extinguishes the smoking material and the second compartment extinguishes matches.

The apparent limitations of these cigarette extinguishers and snuffers have been partly solved by U.S. Pat. No. 4,660,575, which is incorporated herein by reference. This patent discloses a one piece cigarette extinguisher which may be inserted into a cigarette pack or a pocket of the user. The cigarette extinguisher is comprised of a hollow cylinder having an open end for accepting a lit cigarette. A slidable keeper is mounted in the hollow cylinder such that when a cigarette contacts the keeper, a friction fit around the lit cigarette is effectuated.

Additionally, the keeper is able to slide deeper into the hollow cylinder, thereby protecting the unlit end from being damaged.

SUMMARY OF THE INVENTION

The present invention is drawn to an adjustable, one piece, light weight, and portable smoking tobacco extinguisher which can readily be inserted into a conventional pack of cigarettes or a pocket of a user. More specifically, an adjustable device for snuffing out smoking tobacco products of various diameters is disclosed comprised of a housing having a first open end, a second closed end, and a cavity formed therebetween; a slider within the cavity having an opening defined by an inner surface for accepting a burning end of a smoking tobacco product; and an adjustable retainer disposed within the opening wherein the retainer and the slider work in concert to snugly accept the burning end of the smoking tobacco product.

Additionally, an adjustable slider device for use with a smoking tobacco product snuffer is disclosed comprising a tube having a first end, a second end, and an inner surface defining an opening; and a retainer having an attachment end and an adjustable end wherein the attachment end is attached to the inner surface of the tube and proximal to the first end and wherein the adjustable end is not attached to the tube and extends toward the second end of the tube and away from the inner surface of the tube.

DESCRIPTION OF THE DRAWINGS

In the accompanying drawings which illustrate embodiments of the invention.

It is noted that the drawings of the invention are not so scale. The drawings are merely schematic representations, not intended to portray specific parameters of the invention. The drawings are intended to depict only selected embodiments of the invention, and therefore should not be considered to be limiting the scope of the invention. The invention will be described with additional specificity and detail through the use of the accompanying drawings. Like numbering between figures represent like elements.

DETAILED DESCRIPTION OF THE INVENTION

Before the present invention is disclosed and described, it is to be understood that this invention is not limited to the particular process steps and materials disclosed herein as such process steps and materials may vary to some degree. It is also to be understood that the terminology used herein is used for the purpose of describing particular embodiments only and is not intended to be limiting as the scope of the present invention will be limited only by the appended claims and equivalents thereof.

Figure 1:
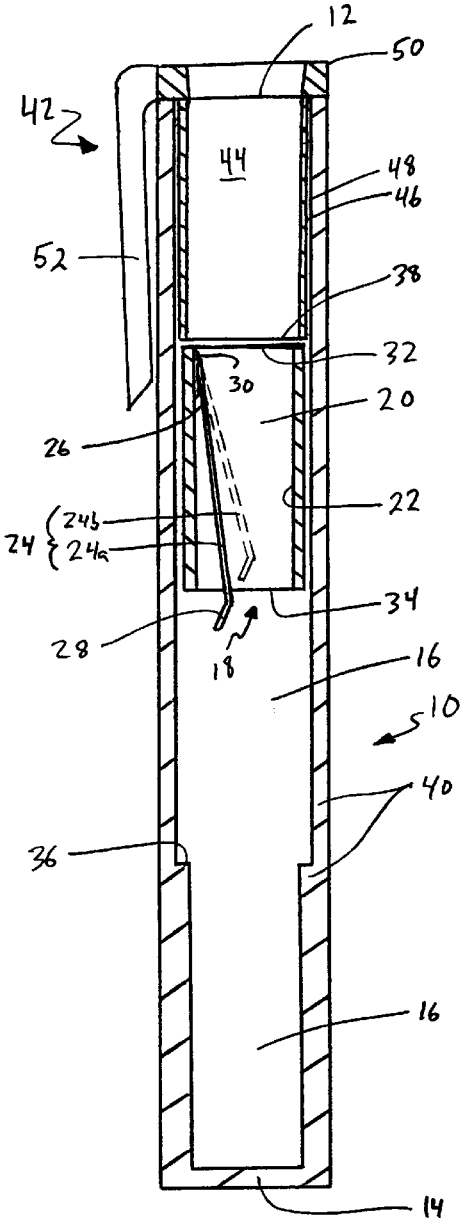
FIG. 1 is a cross-sectional drawing of a device for snuffing out smoking tobacco products.

Referring now to FIG. 1, a cut-away schematic drawing of a device for snuffing out a smoking tobacco product is shown. The device comprises a housing 10 having a first open end 12, a second closed end 14, and a cavity 16 formed therebetween. A slider 18 (which may be defined by a tube) is positioned within the cavity 16. The slider 18 has an opening 20 which is defined by an inner surface 22 for accepting a burning end of a smoking tobacco product (not shown). The opening 20 is preferably configured completely through the slider 18, though this is not required. An adjustable retainer 24 is disposed within the opening 20 wherein the retainer 24 and the slider 18 work in concert to snugly accept the burning end of the smoking tobacco product.

The adjustable retainer 24 may be of different lengths and configurations as is shown by adjustable retainer 24*a* and alternative adjustable retainer 24*b*. Adjustable retainer 24*a* is disposed such that the adjustment end 28 extends beyond the opening 20 of the slider 18. Conversely, the alternative adjustable retainer 24*b* is disposed completely within the opening 20 of the slider 18. Therefore, when referring to the retainer 24, retainers of different lengths and configurations are intended to be described. Additionally, no matter which adjustable retainer is being used, the adjustable retainer 24 is preferably flexible.

The adjustable retainer 24 generally has an attachment end 26 and an adjustment end 28.

The attachment end 26 of the retainer 24 is attached to an inner surface 22 of the slider 18 by an attachment mechanism 30. Preferably, the attachment end 26 is proximal to a first end 32 of the slider 18. Additionally, it is preferred that the adjustment end 28 is disposed such that it is more proximal to a second end 34 of the retainer 18.

The slider 18 is prevented from escaping the device by a first blocking member 36. The first blocking member 36 of the present embodiment is formed by a thickness differential between two areas of a wall 40 of the housing 10. A second blocking member of the present embodiment is also shown. The second embodiment is provided by an insert 42 having a channel 44 formed therethrough. The channel 44 should be broad enough to accept smoking tobacco products of various diameters, but is narrow enough to prevent the slider 18 from escaping through the first open end 12. The insert 42 is further comprised of an exterior surface 46 which preferably forms a friction fit with an interior surface 48 of the cavity 16. Additionally, a ridge 50 is shown which prevents the insert from full entry into the cavity 16. A clip 52 is also shown for attaching the device to a pack of cigarettes or to the pocket of an individual.

Figure 2:
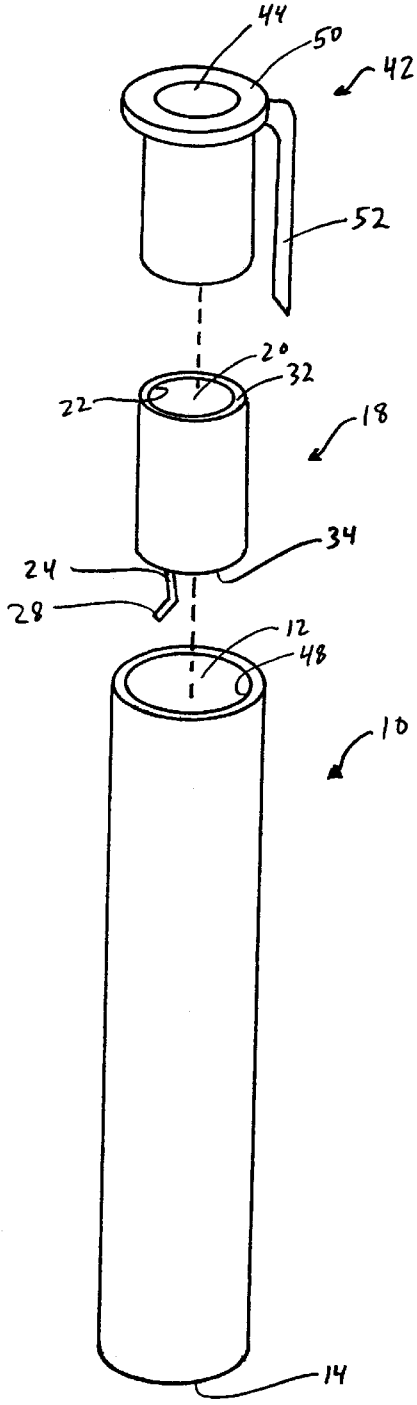
FIG. 2 is an exploded view of a device for snuffing out smoking tobacco products.

Referring now to FIG. 2, an exploded view of a device for snuffing out smoking tobacco products is shown. At the top, an insert 42 is shown having a channel 44, a ridge 50, a clip 52, and an exterior surface 46. A slider 18 is also shown having an inner surface 22 which defines an opening 20. Additionally, the slider 18 has a first end 32 for accepting the burning end of a smoking tobacco product (not shown) and a second end 34. Shown pertruding past the second end 34 is an adjustment end 28 of an adjustable retainer 24. Preferably, the adjustable retainer 24 is flexible. A housing 10 is also shown having a first open end 12, a second closed end 14, a cavity 16, and an interior surface 48. The insert 42 is configured such that the channel 44 is smaller than the exterior diameter of the slider 18. Thus, when the slider 18 is inserted within the housing 10 and the exterior surface 46 of the insert 42 is friction fitted against the interior surface 48 of the housing 10, the slider 18 cannot escape.

Figure 3:
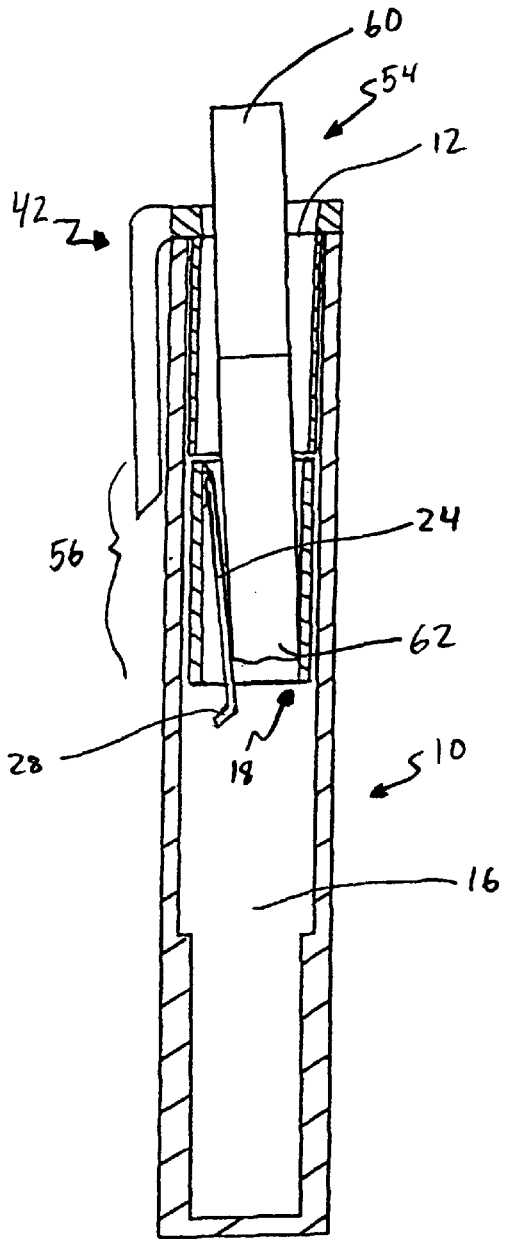
FIG. 3 is a cross-sectional drawing of a device having a tobacco product inserted therein and having a slider in an insertion or removal position.
Figure 4:
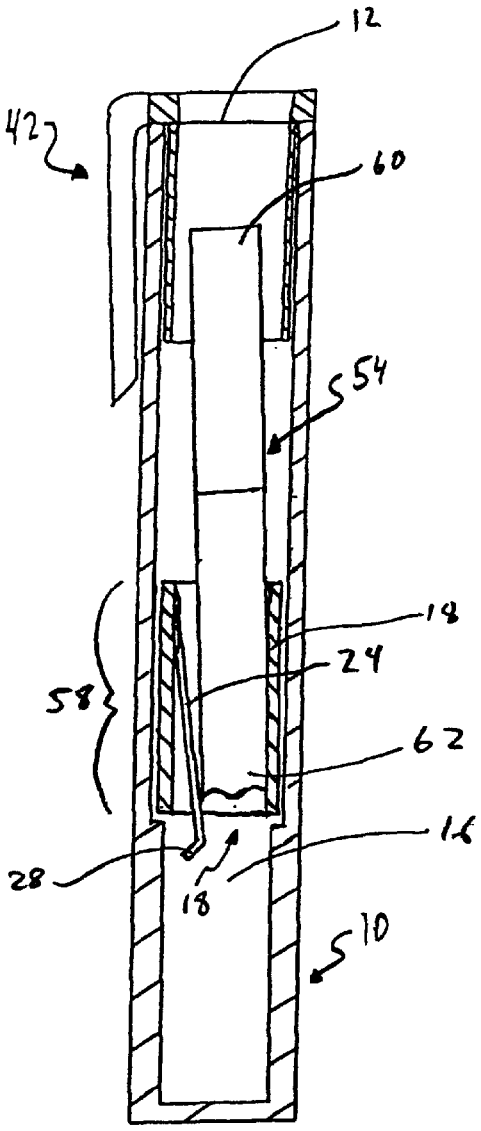
FIG. 4 is a cross-sectional drawing of a device having a tobacco product inserted therein and having a slider in a storage or snuffing position.

Referring now to FIGS. 3 and 4, two cut-away schematic drawings of the same device having a smoking tobacco product 54 inserted therein is shown. FIG. 3 shows a slider 18 in the insertion and removal position 56 and FIG. 4 shows the slider 18 in the storage and snuffing position 58. The structures in FIGS. 3 and 4 are analogous to the structures shown in FIGS. 1 and 2. Functionally, when a snuffing device as described herein is engaged by an inserted cigarette or other smoking tobacco product, the slider 18 is free to move from the insertion position 56 to the snuffing position 58. In the insertion position 56, the user end 60 of the tobacco product 54 is disposed outside of the device. Conversely, when the slider 18 is in the snuffing position 58, the tobacco product 54 is preferably completely within the cavity 16 of the housing 10. Thus, when the housing 10 is inverted or shaken, the slider 18 carrying the tobacco 54 product moves toward the first open end 12 to extend the cigarette beyond the housing 10 at a predetermined distance so that the tobacco product 54 may be retrieved by the user. In either position, the burning end 62 of the tobacco product 54 is preferably held within the opening 20 of the slider 18 until the user exerts enough force on the user end 60 to retrieve the tobacco product 54.

The slider 18 is preferably both adjustable and flexible so that various smoking tobacco products of various diameters may be inserted into such a device with minimal effort. In the embodiment shown in FIGS. 1–4, the insert 42 can be removed so that the slider 18 may also be removed. The adjustment end 28 can then be bent or otherwise adjusted so that the retainer 24 may appropriately accept a smoking tobacco product 54. In other words, the retainer 24 may be easily adjusted in accordance with the diameter of the smoking tobacco product.

Though the description of the drawings describe specific preferred embodiments, this description should not limit the scope of the invention in any way. Essentially, a device for snuffing out smoking tobacco products of various diameters is disclosed comprising a housing having a first open end, a second closed end, and a cavity formed therebetween; a slider within the cavity having an opening defined by an inner surface for accepting a burning end of a smoking tobacco product; and an adjustable retainer disposed within the opening wherein the retainer and the slider work in concert to snugly accept the burning end of the smoking tobacco product.

Additionally, an adjustable slider device for use with a smoking tobacco product snuffer is disclosed comprising a tube having a first end, a second end, and an inner surface defining an opening; and an adjustable and flexible retainer having an attachment end and an adjustable end wherein the attachment end is attached to the inner surface of the tube and proximal to the first end and wherein the adjustable end is not attached to the tube and extends toward the second end of the tube and away from the inner surface of the tube. As stated, the adjustable retainer is preferably flexible so that a cigarette or other smoking tobacco product may be snugly accepted between the inner surface of the slider and the retainer. Additionally, the adjustment end is preferably not attached to the slider.

When referring to the retainer structure disclosed herein, the term "flexible" is intended to include structures that have elastic properties with a propensity to return to an original position when the original position is altered. When referring to the retainer as "adjustable," it is intended to include any mechanism wherein the position of the retainer may be altered to an alternative original position. Such adjustable action can occur by pivoting the retainer at an attachment point or altering the shape of the retainer. Particularly, the shape of the retainer may be altered when the retainer is "bendable," though other mechanisms of altering the shape of the retainer may be used.

In one embodiment, the retainer is attached at the attachment end to the inner surface of the opening and is disposed such that the adjustment end extends beyond the slider. In an alternative embodiment, the retainer is attached at the attachment end to the inner surface of the opening and is disposed such that the adjustment end is completely within the opening. Though both embodiments are described, it is preferred that the adjustment end extends beyond the slider so that the retainer may more easily be adjusted. This is because the adjustment end is easily accessible to the hand of a user as it retainer protrudes beyond the slider. Though a portion of the retainer is referred to herein as the adjustment end, it is important to note that the entire retainer or merely a portion of the retainer may be adjustable.

A preferred adjustment mechanism may be accomplished by providing a retainer that is not only flexible, but bendable. Suitable materials for use include malleable metals and alloys as well as other know materials capable of bending to a specific position and maintaining that position. Additionally, appropriate thicknesses should be used to provide a good balance between rigidity and ease of adjustability. For example, a retainer such as a wire spring can provide such a balance.

Specifically, the device can be adjusted by bending the retainer from the adjustment end. However, bending is not the only adjustment mechanism available as may be ascertained by those skilled in the art based upon the present disclosure, e.g., adjustment may occur by pivoting the retainer at the attachment end. Additionally, it is preferred that the retainer is configured such that the adjustment end is angled away from a smoking tobacco product inserted in the slider. This is done to avoid causing the tobacco product from hanging up on the retainer.

The slider is prevented from escaping the sliding area by two blocking members. A first blocking member is used to prevent the slider from contacting the second closed end of the housing. A preferred first blocking member is a ridge created by a thickness differential between a first and second section of the housing. Additionally, a second blocking member is used to prevent the slider form escaping through the first open end of the housing. The second blocking member is preferably an insert having a channel formed therethrough such that an exterior surface of the insert and an interior surface of a cavity of the housing is proximal to the first open end and creates a friction fit. The insert can have a ridge at one end that is larger than the cavity of the housing such that a portion of the insert does not fit within the cavity. Other blocking member configurations may be used such as blocking rings or other structures. However, the blocking member should not prevent the insertion or removal of the smoking tobacco product.

Because smoking tobacco products are generally cylindrical in shape, the housing is preferably an elongated annulus comprised of a lightweight plastic material. Additionally, because the slider is exposed for a few seconds to a burning end of a smoking tobacco product (prior to extinguishing), the slider is preferably comprised of a material resistant to damage at high temperatures. Exemplary materials include many metals and alloys.

Figure 5:
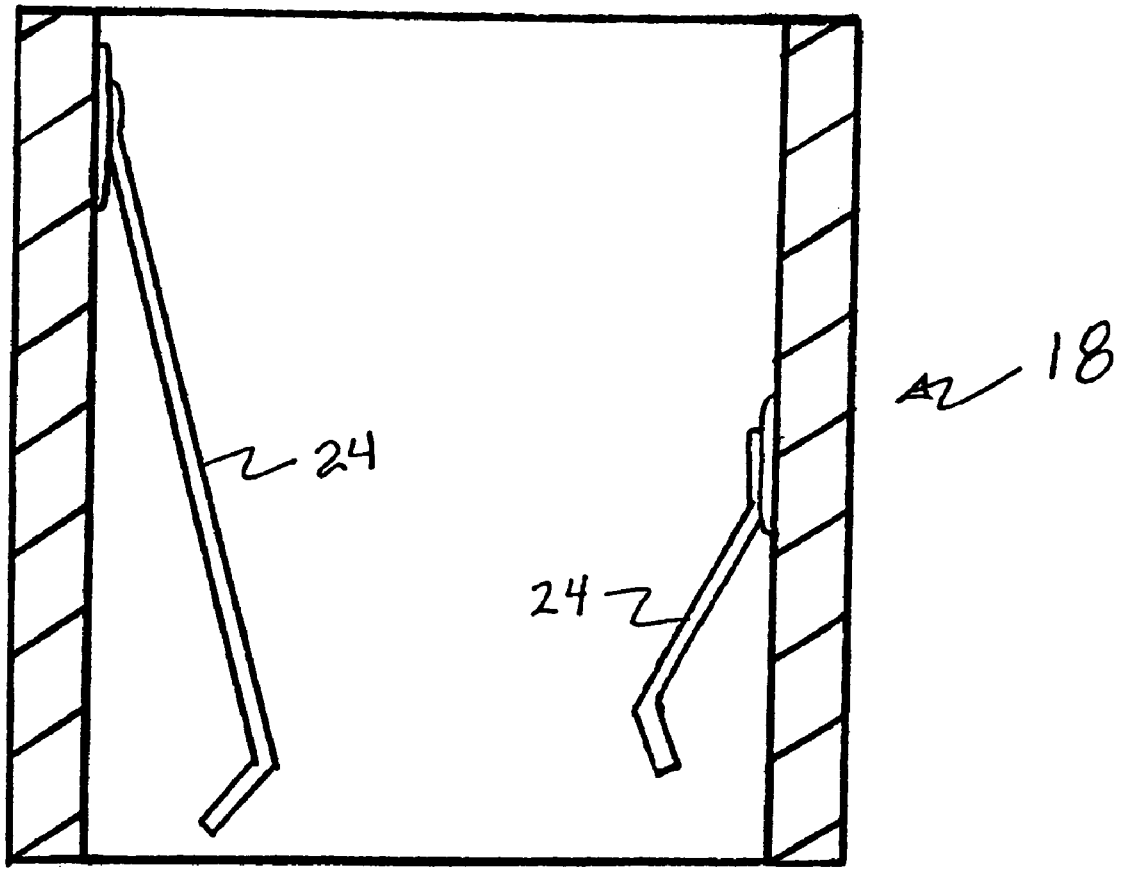
FIG. 5 is a cross-sectional illustration of an alternative embodiment.

Although the illustrated embodiments teach using one retainer 24 it is contemplated to use two or more retainers 24. Specifically, referring to FIG. 5, the retainers could be of different size and/or located at different locations within the slider 18. For example, a short retainer could be places halfway down the slider at a twelve o'clock position and a longer retainer could be positioned at a six o'clock position closer to the top of the slider.

What is claimed is:

1. A device for snuffing out smoking tobacco products of various diameters, comprising:

a) a housing, having a first open end, a second closed end, and a cavity formed therebetween;

b) a slider, positioned within the cavity, having an opening defined by an inner surface for accepting a burning end of a smoking tobacco product; and c) an adjustable retainer, disposed within the slider opening, wherein the retainer and the slider work in concert to snugly accept the burning end of the smoking tobacco product to thereby extinguish and retain the tobacco product, wherein the adjustable retainer is flexible and has an attachment end and an adjustment end;

wherein the adjustment end is not attached to the slider; and wherein the retainer is attached at the attachment end to the inner surface of the opening and is disposed such that the adjustment end extends beyond the slider.

2. The device of claim 1, wherein the retainer is attached at the attachment end to the inner surface of the opening and is disposed such that the adjustment end is completely within the opening.

3. The device of claim 1, wherein the retainer is bendable.

4. The device of claim 3, wherein the device is adjusted by bending the retainer from the adjustment end.

5. The device of claim 1, wherein the retainer at the adjustment end is angled.

6. The device of claim 1, further comprising a first blocking member within the cavity to prevent the slider from contacting the second closed end and a second blocking member within the cavity to prevent the slider form escaping through the first open end.

7. The device of claim 6, wherein the first blocking member is a ridge created by a thickness differential between a first section of the housing and a second section of the housing.

8. The device of claim 6, wherein the slider is cylindrical.

9. The device of claim 6, wherein the second blocking member is an insert having a channel formed therethrough, and wherein an exterior surface of the insert and an interior surface of the cavity proximal to the first open end create a friction fit.

10. The device of claim 9, wherein the insert has a ridge at one end that is larger than the cavity such that a portion of the insert does not fit within the cavity.

11. The device of claim 1, wherein the housing is an elongated annulus.

12. The device of claim 1, wherein the housing is plastic.

13. The device of claim 1, wherein the slider is metal.

14. The device of claim 1, further comprising a clip attached to the device.

15. The device of claim 1, further comprising a second adjustable retainer.

* * * * *